US011035549B2

(12) United States Patent
Liu et al.

(10) Patent No.: US 11,035,549 B2
(45) Date of Patent: Jun. 15, 2021

(54) STRIP LIGHT FIXTURE

(71) Applicants: Self Electronics Co., Ltd., Zhejiang (CN); Wanjiong Lin, Zhejiang (CN); Self electronics USA Corporation, Norcross, GA (US)

(72) Inventors: Xiaoyun Liu, Zhejiang (CN); Zuping He, Zhejiang (CN); Kai Xu, Zhejiang (CN); Jianguo Dong, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/688,741

(22) Filed: Nov. 19, 2019

(65) Prior Publication Data

US 2020/0332980 A1 Oct. 22, 2020

(30) Foreign Application Priority Data

Apr. 19, 2019 (CN) ..... 201910319577.1

(51) Int. Cl.
*F21V 5/00* (2018.01)
*F21V 5/04* (2006.01)
(Continued)

(52) U.S. Cl.
CPC ..... *F21V 5/007* (2013.01); *F21V 5/008* (2013.01); *F21V 5/04* (2013.01); *F21V 17/164* (2013.01);
(Continued)

(58) Field of Classification Search
CPC . F21V 5/04; F21V 5/007; F21V 5/008; F21Y 2103/10; F21Y 2115/10; F21K 9/27
See application file for complete search history.

(56) References Cited

U.S. PATENT DOCUMENTS

2011/0141721 A1* 6/2011 Kato ..... F21V 5/007 362/217.05
2012/0314407 A1* 12/2012 Souvay ..... F21S 4/28 362/191

(Continued)

FOREIGN PATENT DOCUMENTS

JP WO2013154098 * 10/2013

*Primary Examiner* — Evan P Dzierzynski
(74) *Attorney, Agent, or Firm* — Wang Law Firm, Inc.

(57) ABSTRACT

The invention discloses a strip light fixture, comprising lamp holder; circuit board, disposed on the lamp holder; a plurality of point light sources, disposed on the light source mounting surface of the circuit board along the length direction of the strip light fixture; lens, disposed on the lamp holder in a light-emitting direction of the point light source for adjusting light distribution of the point light source on a plane perpendicular to a length direction of the strip light fixture; strip-shaped convex lens array, disposed on an light emitting surface or an light incident surface of the lens and arranged along the length direction of the strip light fixture for converting each point light source into a plurality of consecutive sub point light sources, and the sub point light source converted by the adjacent point light source is docked or coincident. The invention adopts a strip-shaped convex lens array for diffusing light from a point light source only in the length direction of the lamp to form a line light source, so that the illumination surface uniformity in the longitudinal direction of the strip light fixture is improved.

10 Claims, 7 Drawing Sheets

(51) Int. Cl.

| | |
|---|---|
| *F21Y 103/10* | (2016.01) |
| *F21Y 115/10* | (2016.01) |
| *F21V 17/16* | (2006.01) |
| *F21V 31/00* | (2006.01) |

(52) U.S. Cl.
CPC ..... *F21V 31/005* (2013.01); *F21Y 2103/10* (2016.08); *F21Y 2115/10* (2016.08)

(56) References Cited

U.S. PATENT DOCUMENTS

2017/0370539 A1* 12/2017 Xu ..... F21V 5/08
2018/0142846 A1* 5/2018 Liu ..... F21S 4/28

* cited by examiner

STRIP LIGHT FIXTURE

RELATED APPLICATION

This application claims priority to a Chinese Patent Application No. CN 201910319577.1, filed on Apr. 19, 2019.

FIELD OF THE TECHNOLOGY

The present invention relates to lighting technology field, with particular emphasis on a strip light fixture.

BACKGROUND OF THE INVENTION

In the context of energy saving and environmental protection, LED lamps are more and more used in home and commercial lighting field because of their high light emitting efficiency and good focusing performance.

At present, LED lamps on the market mainly use point light source lighting. This type of illumination has problems of glare and reflection glare. In order to solve the above problems, researchers try to replace the point light source with line light source generally by adopting a method of adding a diffusion lamp cover. The diffusion lamp cover diffuses the light from the LED. Since the diffusion direction is not single that the linear light source imaging is messy and fuzzy. The formed linear light source is directly used to illuminate the illuminated surface. The light distribution effect is not good, and the energy attenuation is more, making the formed line light source dim and messy. finally the illumination on the illuminated surface is uneven, resulting in poor lighting effect.

At the same time, the existing improved line source lamps are either bulky, or in order to achieve the line source effect, the LED lamps used are more numerous, which increases the production cost.

BRIEF SUMMARY OF THE INVENTION

In view of this, the present invention provides a strip light fixture to solve the above technical problems.

A strip light fixture comprising:

lamp holder;

circuit board, disposed on the lamp holder;

a plurality of point light sources, disposed on the light source mounting surface of the circuit board along the length direction of the strip light fixture;

lens, disposed on the lamp holder in a light-emitting direction of the point light source for adjusting light distribution of the point light source on a plane perpendicular to a length direction of the strip light fixture;

the strip light fixture further comprising:

strip-shaped convex lens array, disposed on an light emitting surface or an light incident surface of the lens and arranged along the length direction of the strip light fixture for converting each point light source into a plurality of consecutive sub point light sources, and the sub point light source converted by the adjacent point light source is docked or coincident.

When the strip-shaped convex lens array is arranged on a plane, it is a positive cylindrical lens array. When the strip-shaped convex lens array is arranged on a curved surface, the strip-shaped convex lens array is bent along the length direction of the strip-shaped convex lens.

To improve the effect of forming a line light source, advantageously, the light incident surface and the light emitting surface of the lens are each provided with the strip-shaped convex lens array. Both the light incident surface and the light emitting surface are provided with the strip-shaped convex lens array. The two layers of strip-shaped convex lens array enhance the effect of forming line light source. The curvature and density of the strip-shaped convex lens array arranged on the light incident surface and the light emitting surface can be the same or different.

Under the background of energy saving and environmental protection, LED lamps are more and more applied in home and commercial lighting field due to their high light emission efficiency and good light concentration performance, advantageously, the point light source employs LED chips.

In order to improve the light distribution effect, to meet different customer needs, advantageously, the lens comprises a light transmission main part for focusing most of the light of the point light source, and a light transmission secondary part disposed at a certain angle with one side of the light transmission main part to guide a small part of the light of the point light source.

In order to improve the uniformity of the light, advantageously, the light transmission main part projects most of the light to the distal end of the illuminated surface, and the light transmission secondary part directs a small part of the light to the proximal end of the illuminated surface.

In order to further improve the uniformity of light, advantageously, the light transmission main part comprises a light focusing part that guides the light to the far end of the illuminated surface and a light diffusion part that guides the light to the near end of the illuminated surface.

In order to further improve the uniformity of light, advantageously, the curvature of the light emitting surface of the light focusing part changes from large to small in the direction from the light transmission main part to the light transmission secondary part.

In order to further improve the uniformity of light, advantageously, the curvature of the light emitting surface of the light diffusion part changes from large to small in the direction from the light transmission main part to the light transmission secondary part.

In order to improve the effect of the line light source, light emitting surface of the light transmission secondary part needs to be relatively far away from the point light source, and the incoming light is relatively less. In order to ensure uniform illumination on the illuminated surface and avoid dark areas between the corresponding light emitting surfaces of the two rows of light sources when setting two rows of symmetrical point light sources, the light injected into the light transmission secondary part should be concentrated first and then distributed to the required illuminated surface, that is, near-end, and the illumination range is from the directly above the lamp to the region irradiated by the light diffusion part, so that the illumination of the left and right rows of light sources is more uniform. Advantageously, the light transmission secondary part has the effect of concentrating light, and the curvature of the light emitting surface of the light transmission secondary part changes from small to large in the direction from the light transmission main part to the light transmission secondary part.

In order to further improve the uniformity of light, advantageously, on the plane perpendicular to the length direction of the strip light fixture, the included angle formed by the intersection of the light incident surface of the light transmission secondary part and the light incident surface of the light transmission main part is 90°~160°.

In order to obtain the effect of line light source at all angles, advantageously, the light incident surface of the light transmission secondary part is provided with a strip-shaped convex lens array, both the light incident surface and the light emitting surface of the light transmission main part are equipped with a strip-shaped convex lens array.

According to different requirements, the matching point light source and lens can be set with multiple groups to increase the luminous angle, advantageously, the circuit board provided with a plurality of point light sources is symmetrically arranged with two pieces, correspondingly, the lens is provided with two symmetrical ones.

Technical Effects of the Present Invention

The strip light fixture of the present invention adopts a strip-shaped convex lens array which forms a line light source only by diffusing light from the point light source only in the length direction of the strip light fixture, so that the illumination surface uniformity in the length direction of the strip light fixture is improved, which can preventing light from diffusing in multiple directions, so that the line source is purified, and the lens is arranged to perform light distribution in the other direction to the line source, thereby reducing energy attenuation; The secondary light distribution of the lens can achieve the uniform distribution of light according to the needs, making the uniformity of illumination approaching 1, thereby improving the light-sweeping effect; without adding parts, the structure is compact.

BRIEF DESCRIPTION OF THE DRAWINGS

Embodiments of the present invention are described below in conjunction with the accompanying drawings, as follows:

FIG. 4 is a schematic diagram of the sectional structure in the A-A direction of

FIG. 3.

DETAILED DESCRIPTION OF THE INVENTION

Figure 1:
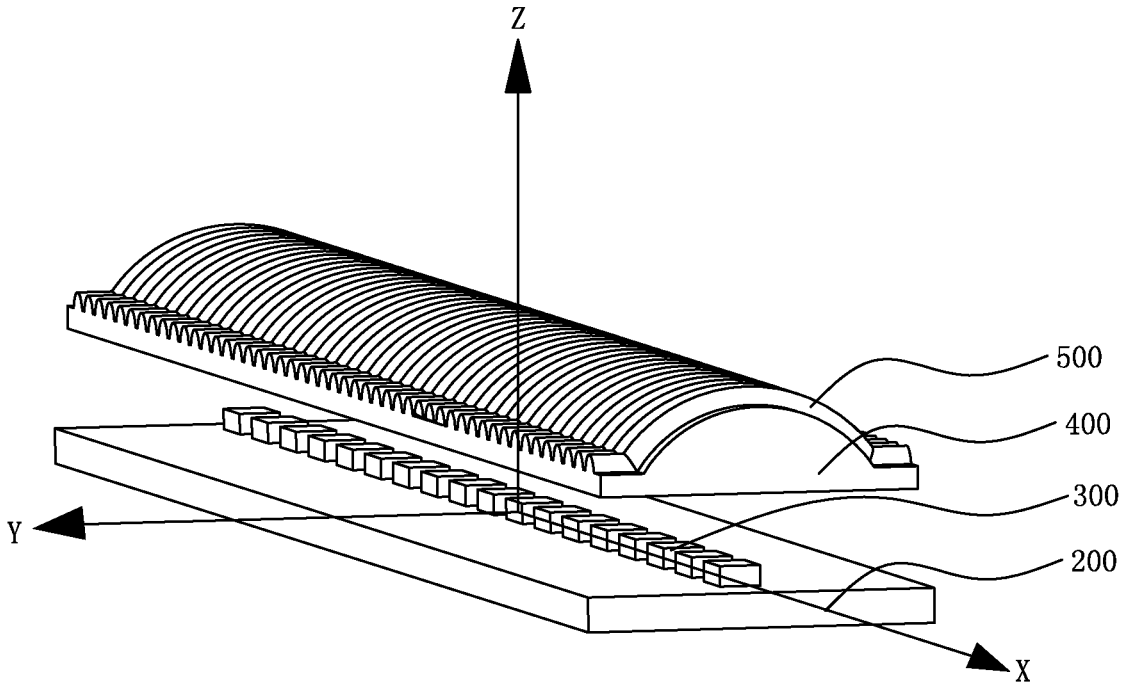
FIG. 1 is a schematic diagram of principle structure of a strip light fixture of the present invention.
Figure 2:
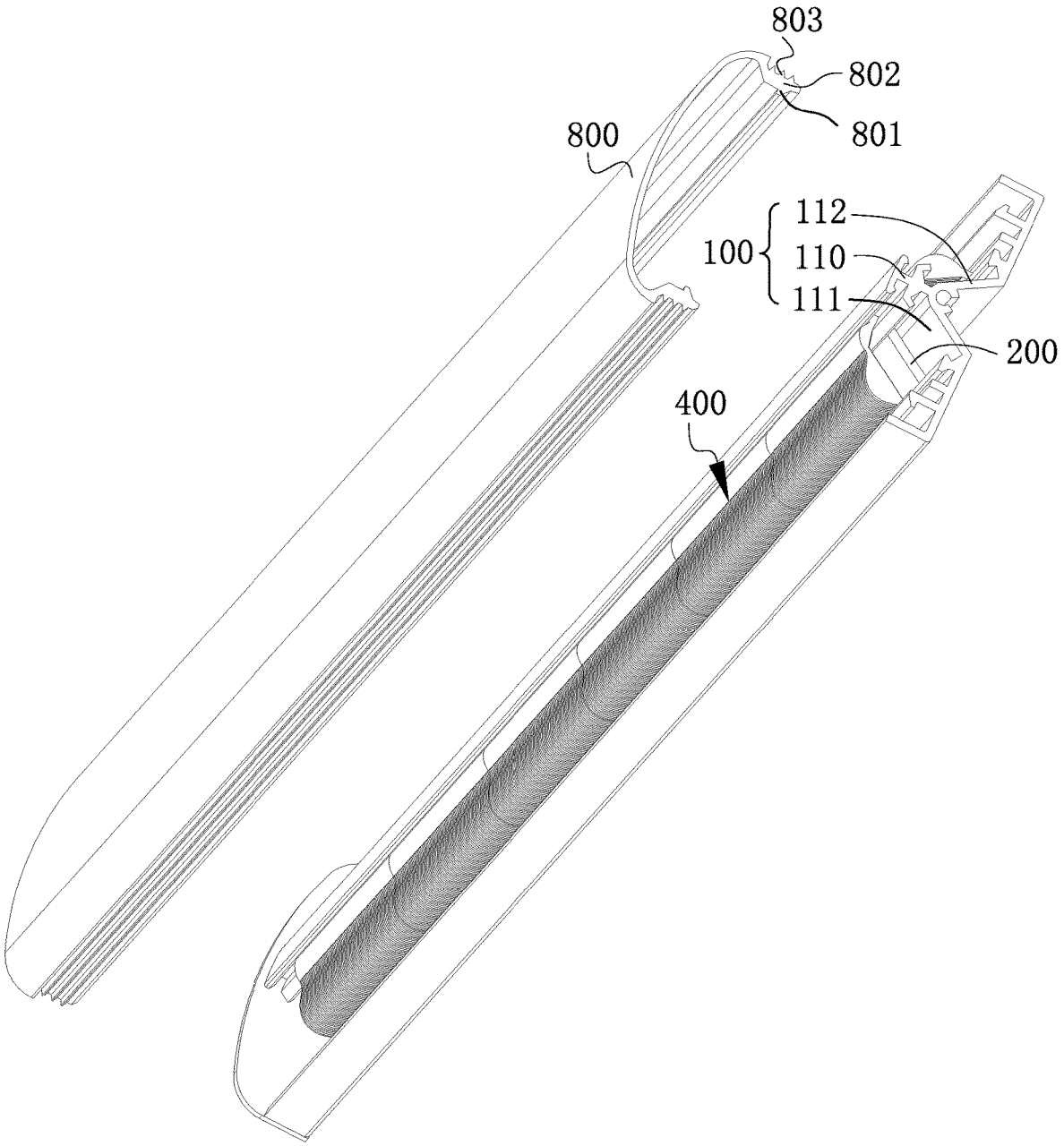
FIG. 2 is a three-dimensional structure diagram of a strip light fixture of the present invention.

Specific embodiments of the present invention will be further described in detail below based on the drawings. It should be understood that the description of the embodiments herein is not intended to limit the scope of the invention.

As shown in FIG. 1-7, the strip light fixture of the present embodiment comprises a lamp holder 100, a circuit board 200, a plurality of point light sources 300, a lens 400 provided with a strip-shaped convex lens array 500, and a lamp cover 800.

The strip-shaped convex lens array 500 and the lens 400 are integrally formed, and the strip-shaped convex lens array 500 is disposed on the exit surface of the lens 400.

In the context of energy saving and environmental protection, LED lamps are increasingly used in home and commercial lighting because of their high light emitting efficiency and good focusing performance. The point light source 300 uses LED chips, of course, other forms of point light sources can also be used.

In this embodiment, the optical axis direction of the point light source 300 is set to be Z direction, and the mounting surface of the point light source 300 is a plane perpendicular to the Z direction. On the mounting surface, the arrangement direction of the point light source 300 is X direction, defining Y direction which is perpendicular to the X direction. The circuit board 200 is also disposed on the mounting surface, and the XYZ coordinate system can define an X-Y plane, a Y-Z plane, and an X-Z plane.

A strip-shaped convex lens array 500 is arranged on the lens 400 along the length direction of the strip light fixture for refracting light from each point light source 300, and the light of the adjacent point light sources 300 refracted by the lens 400 overlap to produce a line light.

The lamp holder 100 comprises a first strip base 111 and a second strip base 112 which are separated by a partition fixing plate 110. Two circuit boards 200 provided with the plurality of point light sources 300 are symmetrically arranged, respectively mounted on the first strip base 111 and the second strip base 112. Correspondingly, two lenses 400 are provided, which are respectively symmetrically installed in the first strip base 111 and the second strip base 112. On a plane perpendicular to the length direction of the strip light fixture, the circuit board 200 is inclined with respect to the illuminated surface 700 to increase the illumination range. The first strip base 111 has a flat portion 115 and an inclined portion 116 and the second strip base 112 has a flat portion 117 and an inclined portion 118. The inclined portion 116 of the first strip base 111 connects the inclined portion 119 of the second strip base 112 forming an inverted V shape 119.

The outer side of the first strip base 111 and the second strip base 112 are connected to the two sides of the lamp cover 800 through a clasp structure, and the outer side of the clasp structure 801 disposed on both sides of the lamp cover 800 is provided with a soft seal 802. The soft seal 802 is interference fit with the inner side wall of the first strip base 111 and the second strip base 112. In the embodiment, the soft seal 802 is provided with a serration 803 on a side toward the inner side wall of the strip bases. The serration 803 can increase the contact tightness between the soft seal 802 and the inner wall of the strip bases, thereby providing a good waterproof effect. The strip light fixture of the present embodiment has a symmetrical structure, and the left and right rows of the strip light fixture have the same structure. Therefore, only the right row of the strip light fixture is used for detailed description, and the left row structure is the same, and will not be described below.

The lens 400 comprises a light transmission main part 401 for focusing most of the light of the point light source 300, and a light transmission secondary part 402 disposed at a certain angle with one side of the light transmission main part 401 to guide a small part of the light of the point light source 300. The light transmission main part 401 projects most of the light to the distal end of the illuminated surface 700, and the light transmission secondary part 402 directs a small part of the light to the proximal end of the illuminated surface 700.

In the light beam guided by the light transmission main part 401, there are also some light closer or farther to the illuminated surface 700. The light transmission main part 401 comprises a light focusing part 4011 that guides the light to the far end of the illuminated surface 700 and a light diffusion part 4012 that guides the light to the near end of the illuminated surface 700. The light beam that is closer to the illuminated surface 700 is diffused, and the light beam that is farther from the illuminated surface 700 is focused, thereby making the light uniformity better.

Figure 3:
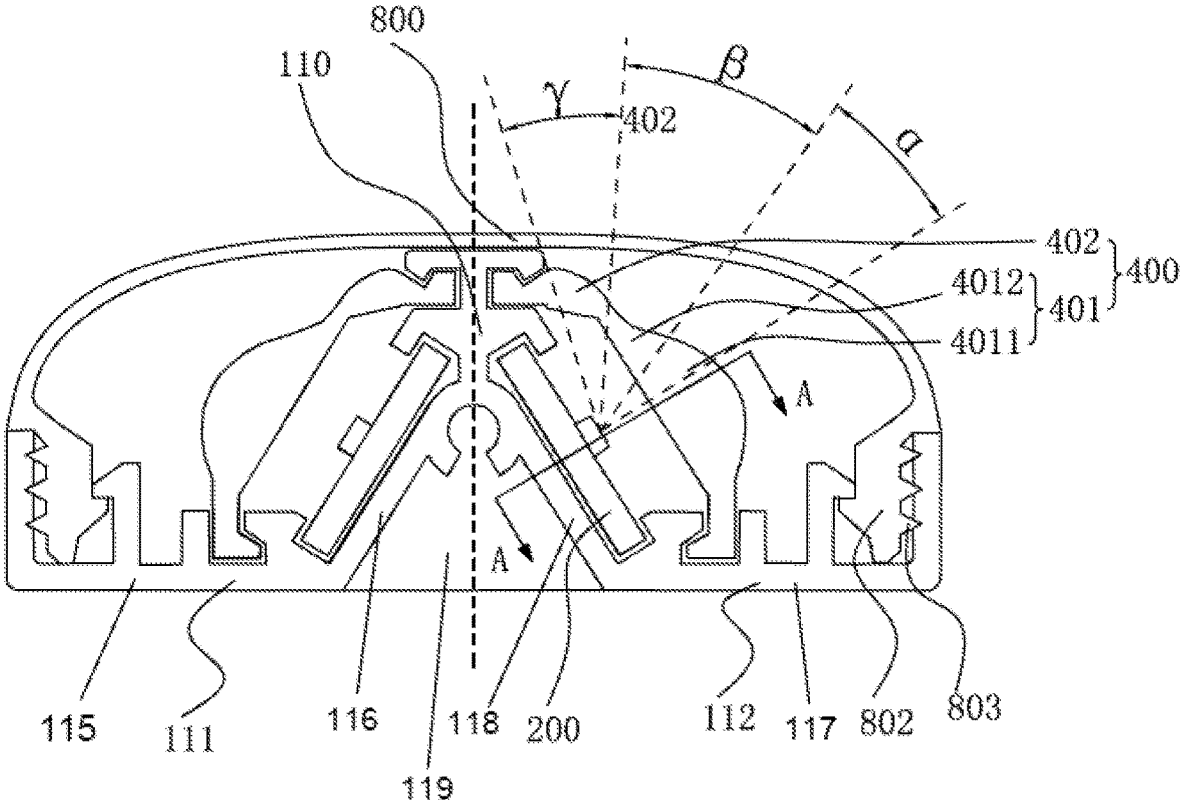
FIG. 3 is a structure diagram of a strip light fixture of the present invention.
Figure 4:
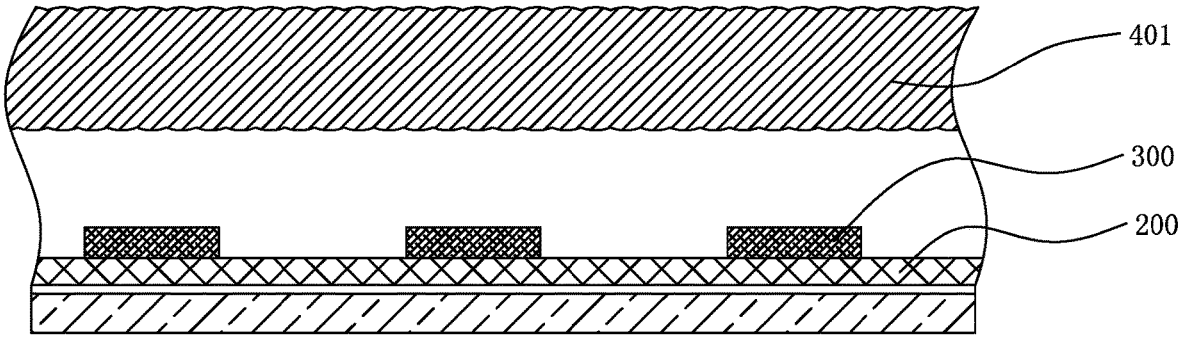
Figure 5:
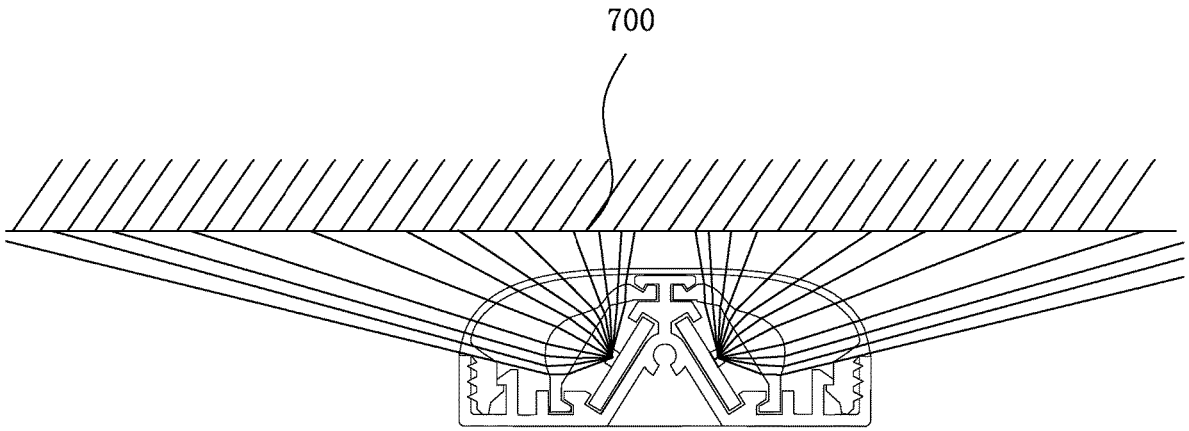
FIG. 5 is a schematic diagram showing the light output of the strip light fixture on the illuminated surface of the present invention.
Figure 6:
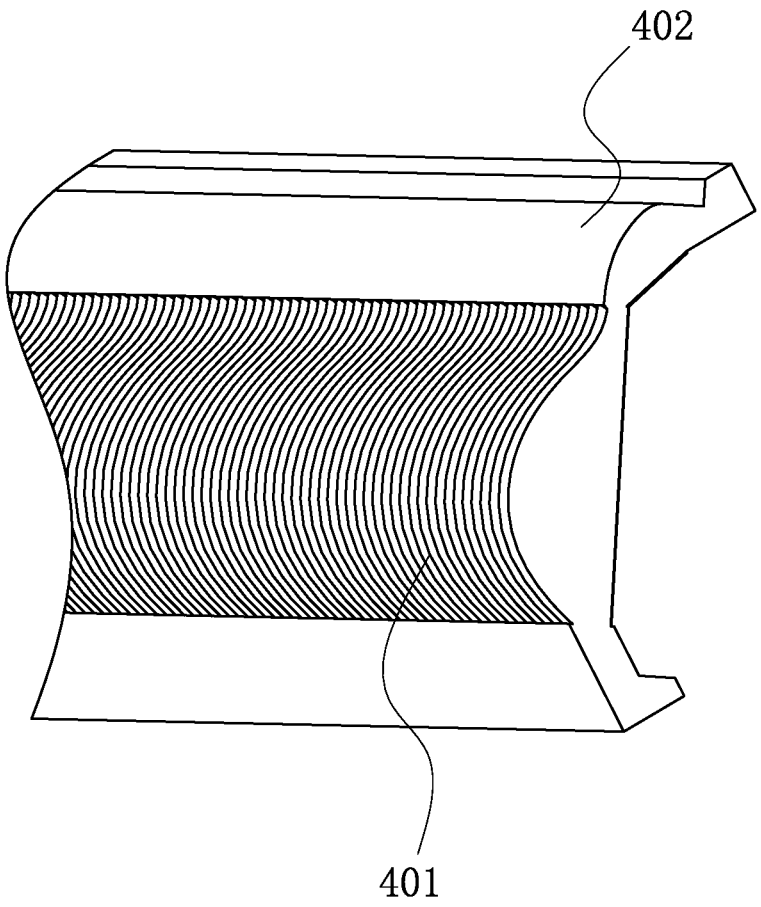
FIG. 6 is a three-dimensional structure diagram of the lens of the present invention.
Figure 7:
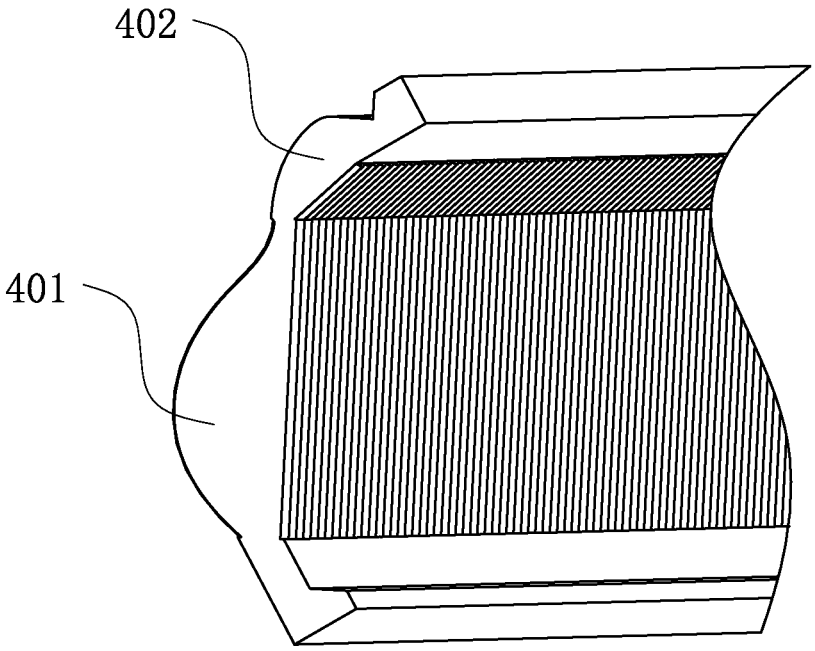
FIG. 7 is a three-dimensional structure diagram of another angle of the lens of the present invention.

In this embodiment, the illuminated surface 700 is disposed on a horizontal surface. The circuit board 200 is disposed obliquely with respect to the horizontal plane, and the side away from the exposure surface 700 is set inclined outward. The light incident surface of the light transmission main part 401 is disposed in parallel with the circuit board 200. The light emitting surface of the light transmission main part 401 is a curved surface. As shown in FIG. 3, on the cross section perpendicular to the length direction of the strip light fixture, the intersection angle ($\alpha$) between the optical axis of the point light source and the line obtained by connecting the light-emitting boundary point a of the light focusing part 4011 with the center point of the point light source is 20~30°, the intersection angle ($\alpha+\beta$) between the optical axis of the point light source and the line obtained by connecting the light-emitting boundary point b of the light diffusion part 4012 with the center point of the point light source is 40~60°, the intersection angle ($\alpha+\beta+\gamma$) between the optical axis of the point light source and the line obtained by connecting the light-emitting boundary point c of the light transmission secondary part 402 with the center point of the point light source is 60~90°. The light-emitting boundary of the light transmission secondary part 402 away from the optical axis of the point light source 300 is inclined to the light source on the other side.

In order to improve the effect of the line light source, the light transmission secondary part 402 needs to be relatively far away from the point light source 300, and the incoming light is relatively less. In order to ensure uniform illumination on the illuminated surface and avoid dark areas between the corresponding light emitting surfaces of the two rows of light sources, the light injected into the light transmission secondary part 402 should be concentrated first and then distributed to the required illuminated surface and the illumination range is from the directly above the lamp to the region irradiated by the light diffusion part 4012, so that the illumination of the left and right rows of light sources is more uniform. The light transmission secondary part 402 has the effect of concentrating light, and the curvature of the light emitting surface of the light transmission secondary part 402 changes from small to large in the direction from the light transmission main part 401 to the light transmission secondary part 402.

The curvature of the light emitting surface of the light focusing part 4011 changes from large to small in the direction from the light transmission main part 401 to the light transmission secondary part 402 to improve the uniformity of the outgoing light. The curvature of the light emitting surface of the light diffusion part 4012 changes from large to small in the direction from the light transmission main part 401 to the light transmission secondary part 402 to improve the uniformity of the outgoing light.

The light incident surface of the light transmission secondary part 402 is provided with the strip-shaped convex lens array 500, and the light incident surface and the light emitting surface of the light transmission main part 401 are each provided with the strip-shaped convex lens array 500. The two light incident surfaces are all flat. At this time, the strip-shaped convex lens array is a positive cylindrical lens array, the light emitting surface is a curved surface, and the strip-shaped convex lens array is curved along the length direction of the strip-shaped convex lens.

On the plane perpendicular to the length direction of the strip light fixture, the light incident surface of the light transmission secondary part 402 and the light incident surface of the light transmission main part 401 are straight lines, and the angle formed by the intersecting straight lines is 90°~160°.

The light transmission secondary part 402 is far away from the point light source 300, and the light incident surface is provided with a strip-shaped convex lens array 500; the light transmission main part 401 is close to the point light source 300. In order to improve the effect of presenting line light source, both the light incident surface and the light emitting surface are equipped with a strip-shaped convex lens array 500.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A strip light fixture comprising:

a lamp holder composed of a first strip base and a second strip base, the first strip base having a flat portion and an inclined portion, the second strip base having a flat portion and an inclined portion, the inclined portion of the first strip base connects with the inclined portion of the second strip base forming an inverted open V shape;

a circuit board (200) mounted on the first strip base on the lamp holder;

a plurality of point light sources, disposed on a light source mounting surface of the circuit board along a lengthwise direction of the strip light fixture;

a lens mounted on the first strip base on the lamp holder in a light-emitting direction of the point light source for adjusting light distribution of the point light source on a plane perpendicular to the lengthwise direction of the strip light fixture;

a strip-shaped convex lens array, disposed on an light emitting surface or an light incident surface of the lens and arranged along the lengthwise direction of the strip light fixture for refracting light from each point light source, and the light of the adjacent point light sources refracted by the lens overlap.

2. The strip light fixture as claimed in claim 1, wherein the light incident surface and the light emitting surface of the lens are each provided with the strip-shaped convex lens array.

3. The strip light fixture according to claim 1, wherein the point light source employs LED chips.

4. The strip light fixture as claimed in claim 1, wherein the lens comprises a light transmission main part for focusing most of the light of the point light source, and a light transmission secondary part disposed at a certain angle with one side of the light transmission main part to guide a part of the light of the point light source.

5. The strip light fixture as claimed in claim 4, wherein the light transmission main part comprises a light focusing part that guides the light to the far end of the illuminated surface and a light diffusion part that guides the light to the near end of the illuminated surface.

6. The strip light fixture as claimed in claim 5, wherein the curvature of the light emitting surface of the light focusing part decreases in the direction from the light transmission main part to the light transmission secondary part.

7. The strip light fixture as claimed in claim 5, wherein the curvature of the light emitting surface of the light diffusion part decreases in the direction from the light transmission main part to the light transmission secondary part.

8. The strip light fixture as claimed in claim 4, wherein the light transmission secondary part has the effect of concentrating light, and the curvature of the light emitting surface of the light transmission secondary part increases in the direction from the light transmission main part to the light transmission secondary part.

9. The strip light fixture as claimed in claim 4, wherein the light transmission main part projects most of the light to the distal end of the illuminated surface and the light transmission secondary part directs a part of the light to the proximal end of the illuminated surface.

10. The strip light fixture as claimed in claim 1, wherein the circuit board provided with a plurality of point light sources is symmetrically arranged with two pieces, correspondingly, two symmetrical lenses are provided.

* * * * *